US007306118B1

(12) United States Patent
Korte et al.

(10) Patent No.: US 7,306,118 B1
(45) Date of Patent: Dec. 11, 2007

(54) PAINT CONTAINER

(75) Inventors: Stanley G. Korte, St. Louis, MO (US); William B. Hudson, Jr., Arnold, MO (US); Jeffrey A. Schutte, University City, MO (US); Norman F. Morfeld, High Ridge, MO (US); Douglas W. Newman, St. Charles, MO (US); Mark A. Gilbertson, Prairie du Sac, WI (US); Scott G. Manke, Sun Prairie, WI (US); Michael J. Walsh, Chesterfield, MO (US)

(73) Assignee: Masterchem Industries LLC, Imperial, MO (US)

( * ) Notice: Subject to any disclaimer, the term of this patent is extended or adjusted under 35 U.S.C. 154(b) by 188 days.

(21) Appl. No.: 10/899,450

(22) Filed: Jul. 26, 2004

Related U.S. Application Data

(60) Provisional application No. 60/490,398, filed on Jul. 25, 2003.

(51) Int. Cl.
*B65D 25/46* (2006.01)

(52) U.S. Cl. ..... 222/109; 222/153.14; 222/500; 222/535; 222/568

(58) Field of Classification Search ..... 222/109, 222/153.14, 424, 500, 533, 535, 536, 567, 222/568
See application file for complete search history.

(56) References Cited

U.S. PATENT DOCUMENTS

| | | | | |
|---|---|---|---|---|
| 134,586 | A * | 1/1873 | Bradley | 215/235 |
| 1,377,801 | A * | 5/1921 | Brown | 222/513 |
| 2,041,784 | A * | 5/1936 | Shore | 222/498 |
| 2,332,524 | A * | 10/1943 | Nyden | 222/533 |
| 5,267,675 | A * | 12/1993 | Cane | 222/556 |
| 6,685,055 | B2 * | 2/2004 | Taylor | 222/83 |

* cited by examiner

*Primary Examiner*—Joseph A. Kaufman
(74) *Attorney, Agent, or Firm*—Foley & Lardner LLP

(57) ABSTRACT

A method and apparatus for transporting fluid. The apparatus includes a hollow body having a neck defining a first aperture extending into the body. A spout insert is configured to fit inside the neck. A handle is coupled to the container. A cover is configured to close the aperture. In another embodiment the handle and cover are integrally formed as a single piece. Another embodiment provides the handle, the cover and the spout are integrally formed as a single piece. In another embodiment, the cover includes an auxiliary lid to cover a second aperture extending into the body.

21 Claims, 9 Drawing Sheets

PAINT CONTAINER

CROSS-REFERENCE TO RELATED PATENT APPLICATIONS

This application is a An application claiming the benefit under 35 USC 119(e) U.S. Application 60/490,398, filed Jul. 25, 2003, incorporated herein by reference in its entirety. The following U.S. patent applications are cited by reference: U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001, which is hereby incorporated by reference.

FIELD

The present inventions relate generally to the field of paint containers. More specifically, the present inventions relate to a container for the distribution, sale and use of paint.

BACKGROUND OF THE INVENTION

It is known to provide a paint container. However, such known paint containers do not realize certain advantageous features and/or combinations of features.

SUMMARY OF THE INVENTION

The present inventions relate to a system for containing paint. The system comprises a body between a cover and a base. The system also comprises a handle configured for attachment to the body and selectively configurable between a first position and a second position.

There is provided a paint container comprising a body including a bottom, at least one sidewall, a top having an opening extending therethrough to an interior of the body defined by the top, bottom and sidewall. A spout is movable from the retracted position wherein at least a portion of the spout is within the interior of the body to an extended position wherein at least an upper edge of the spout is outside the interior of the body. In another embodiment, the spout pivots about the hinge to move between the retracted and extended position.

There is also provided an apparatus for transporting fluid. The apparatus includes a hollow body having a neck defining a first aperture extending into the body. A spout insert is configured to fit inside the neck. A handle is coupled to the container. A cover is configured to close the aperture. In another embodiment the handle and cover are integrally formed as a single piece. Another embodiment provides the handle, the cover and the spout are integrally formed as a single piece. In another embodiment, the cover includes an auxiliary lid to cover a second aperture extending into the body.

There is also provided the kit for transporting fluid. The kit comprises a container configured as a hollow body and having a neck defining an aperture extending into the body. A means for directing the fluid is inserted into the aperture. A means for holding is coupled to the container and a means for closing the aperture.

There is further provided a method for facilitating paint use. The paint is contained in the hollow body with the body having a neck defining an aperture and a spout insert positioned in the aperture. The method comprises the steps of providing a cover configured to close the aperture and coupled to the neck. Converting the cover to expose a paint receiving area defined by the cover. Pouring paint from the body into the paint receiving area. Another embodiment includes the steps of removing paint from the paint receiving area and using the cover to close the aperture. Another embodiment comprises the cover with a snap fastener configured to engage the neck and close the aperture.

It is important to note that the term "paint" as used in this disclosure is intended to be a broad term and not a term of limitation. The term "paint" as used in this disclosure may include, without limitation any decorative or functional surface treatment, liquid dispersion, finish, surface finish, varnish, pigment, colorant, other coating, etc. According to a particularly preferred embodiment, the liquid paint is an acrylic latex coating such as the KILZ CASUAL COLORS exterior flat acrylic latex coating commercially available from Masterchem Industries, Inc. of Imperial, Mo.

It is also important to note that the terms "upright," "prone," "horizontal," "vertical," "top," "middle," "bottom," etc., as used in this disclosure with reference to the embodiments shown in the FIGURES are intended to be broad terms and not terms of limitation. It will be understood, however, that the paint container shown in the FIGURES may be positioned in any of a variety of orientations and the orientations illustrated in the FIGURES is not intended to be limiting.

It is also important to note that the terms "up," "down," "forward," "aft," etc. as used in this disclosure with reference to the embodiments shown in the FIGURES are intended to be broad terms and not terms of limitation. It will be understood, however, that the paint container and the handle shown in the FIGURES may be positioned in any of a variety of orientations and the orientations illustrated in the FIGURES are not intended to be limiting.

DETAILED DESCRIPTION OF THE PREFERRED EMBODIMENTS

Figure 1:
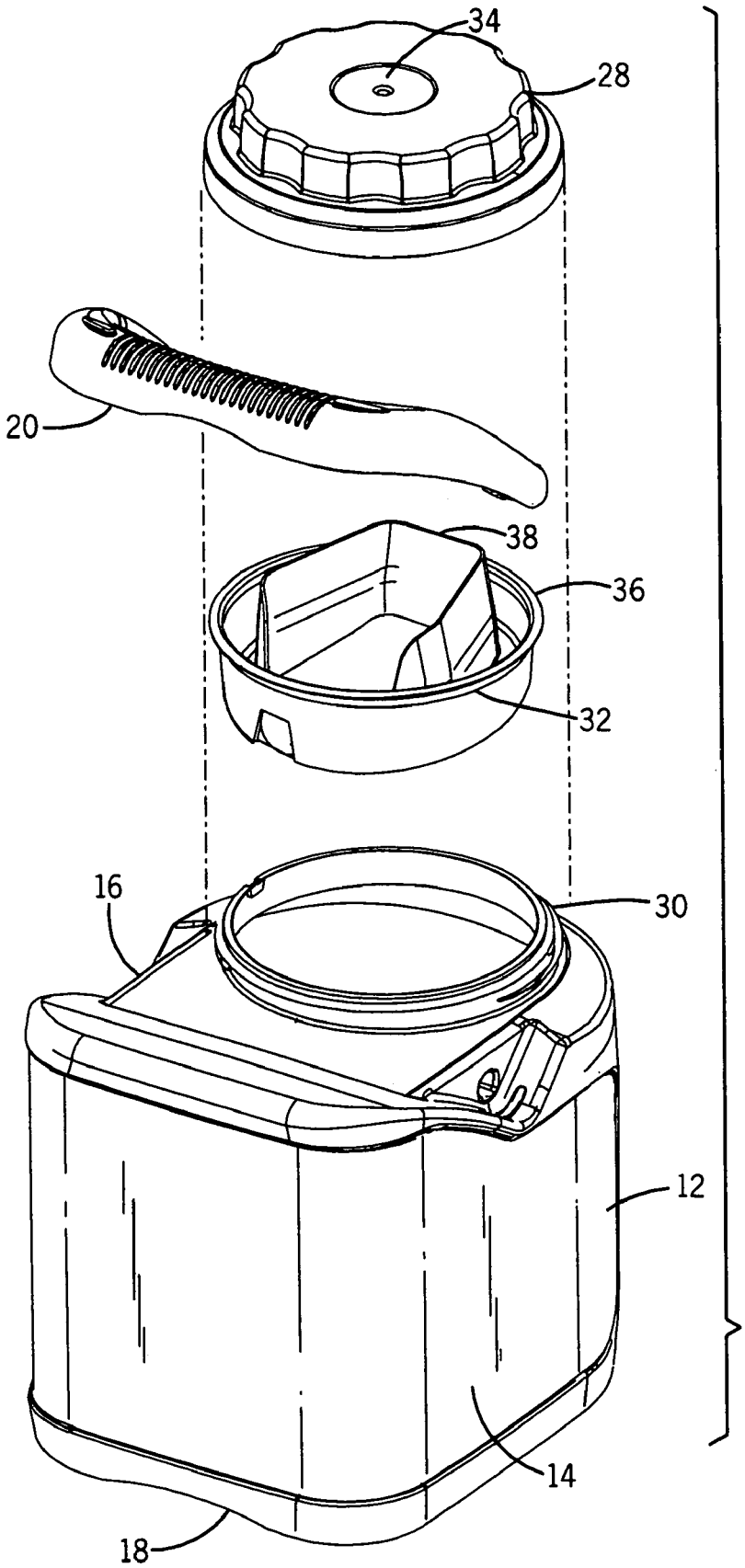
FIG. 1 is an exploded perspective view of a system for containing paint according to an exemplary embodiment.

Referring to FIG. 1, a system for containing paint (shown as a paint container 10) is shown according to a preferred embodiment. Container 10 includes a body 12 formed by a vertical side wall 14 extending between a horizontal cover 16 and a horizontal base 18. A bail or handle 20 is attached to side wall 14 of body 12 by a locking system or mechanism 22. Handle 20 is selectively configurable between a horizontal "down" or closed storage position 24 (see FIG. 3) and a vertical "up" or open use position 26 (see FIG. 2). A cap or lid 28 is shown in FIG. 1 threadably attached to a neck 30 (see also FIG. 3). A removable pour spout 32 is shown in FIG. 1 as being insertable into neck 30 for removing paint from container 10 according to a preferred embodiment.

Referring further to FIG. 1, spout insert 32 includes an outer lip 36. Insert 32 is secured to the body 12 by either an adhesive, friction fit, snap fit, welding, or any other method known in the art. Insert includes a spout 38. In one embodiment spout 38 extends upward above the outer lip 36.

Figure 2:
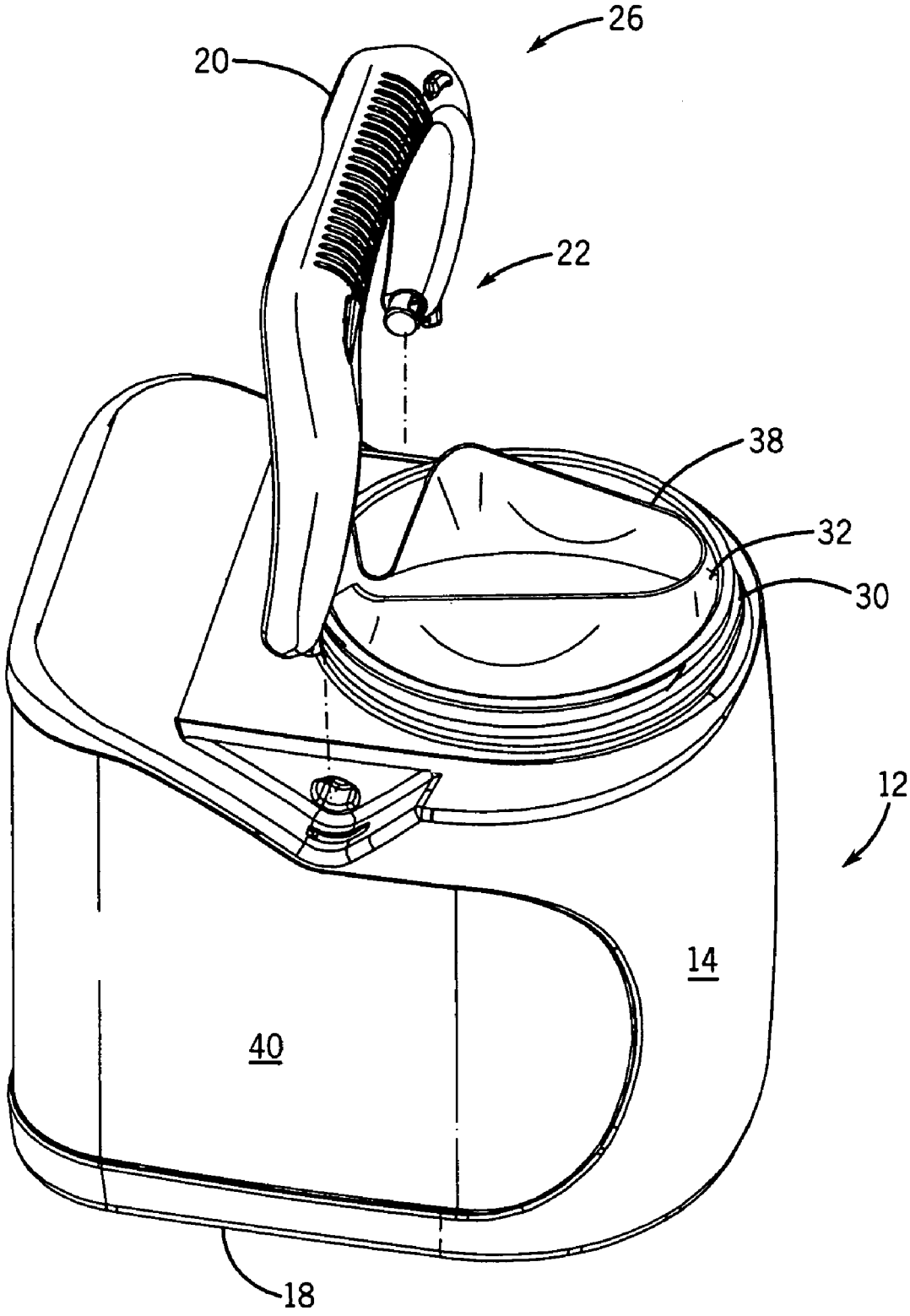
FIG. 2 is an exploded perspective view of a system for containing paint according to another exemplary embodiment.
Figure 3:
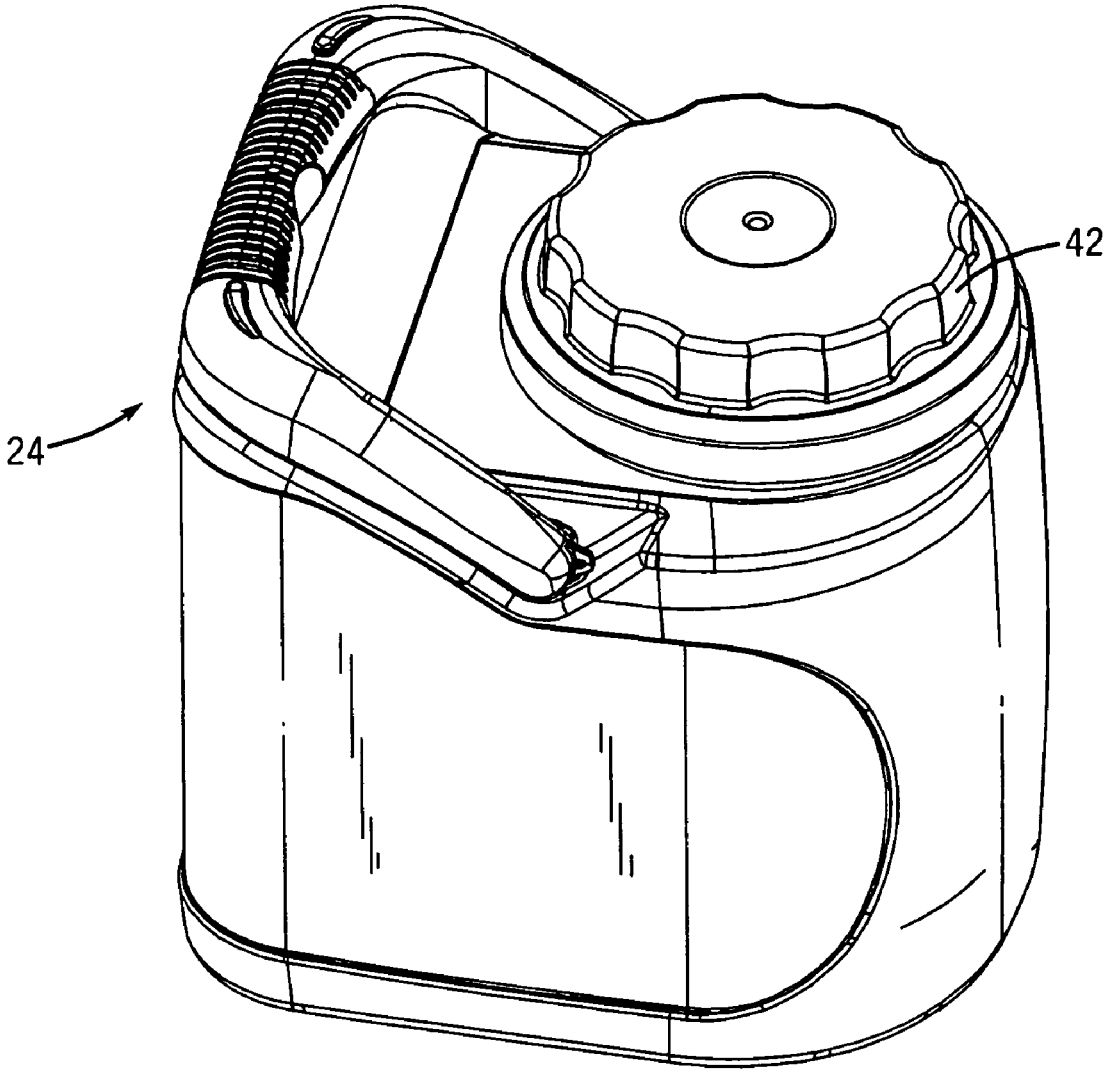
FIG. 3 is a perspective view of the system for containing paint of FIG. 2 showing a handle in a storage position according to an exemplary embodiment.

Referring to FIGS. 2 and 3, paint container 10 has a perimeter that is "D"-shaped, a cross-section that is substantially "D"-shaped, and a substantially flat bottom that is substantially "D"-shaped. According to a particularly preferred embodiment, the container is configured to hold a volume of about one gallon of paint, and may have other volumes (e.g. one quart) according to other alternative embodiments. According to a particularly preferred embodiment, the lid of the container has an area of about 12.4 square inches. According to a particularly preferred embodiment, the container is of the type disclosed in U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001.

As shown in FIGS. 2 and 3, body 12 includes a recessed region 40. Recessed region 40 may receive a label for indicia and/or information that could be applied during the forming operation such as in the mold, or a label may be affixed to the container after the container has been formed.

Referring to FIG. 3, cap 28 further includes finger recesses 42 to facilitate closing and opening of cap 28 as well as holding cap 28. A top surface 34 of cap 28 includes a substantially planar surface portion to enable top surface 34 to rest on a support surface so that cap 28 in an inverted position may serve as a paint dish having a cavity or paint area 50 (see FIGS. 4 through 6).

Figure 4:
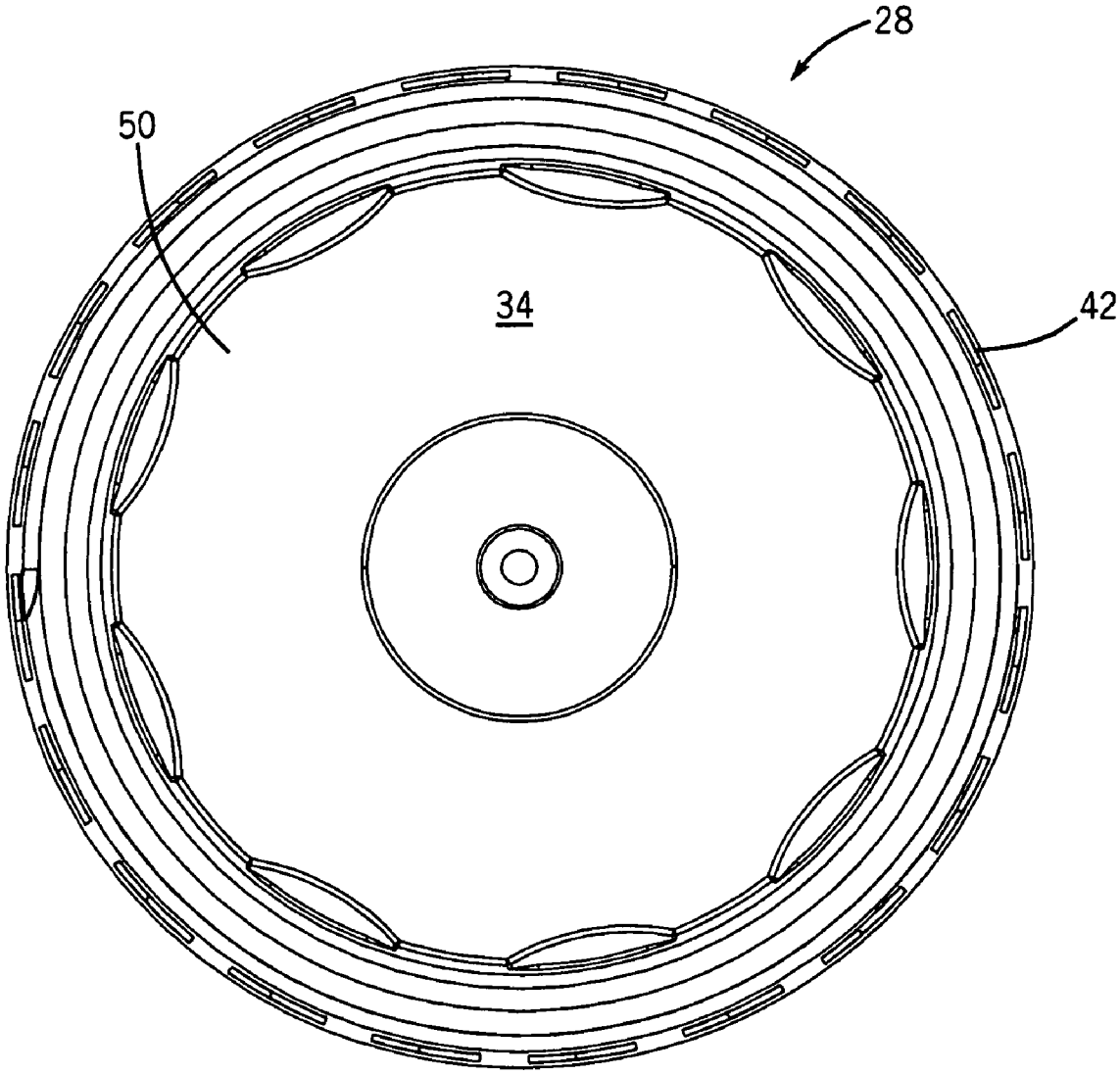
FIG. 4 is a bottom view of a cap or lid of the paint container according to an exemplary embodiment.
Figure 5:
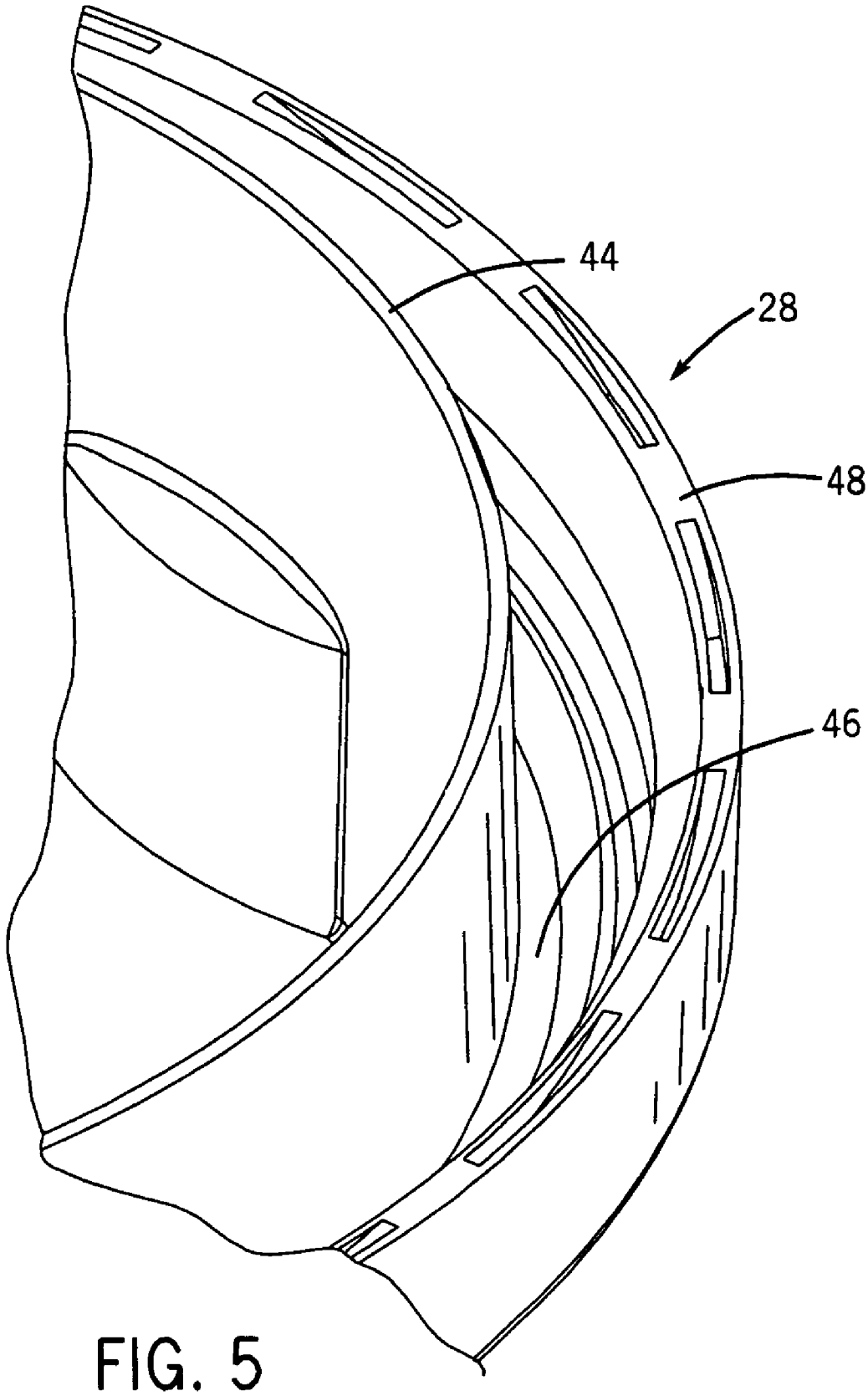
FIG. 5 is a bottom view of the lid of FIG. 4.
Figure 6:
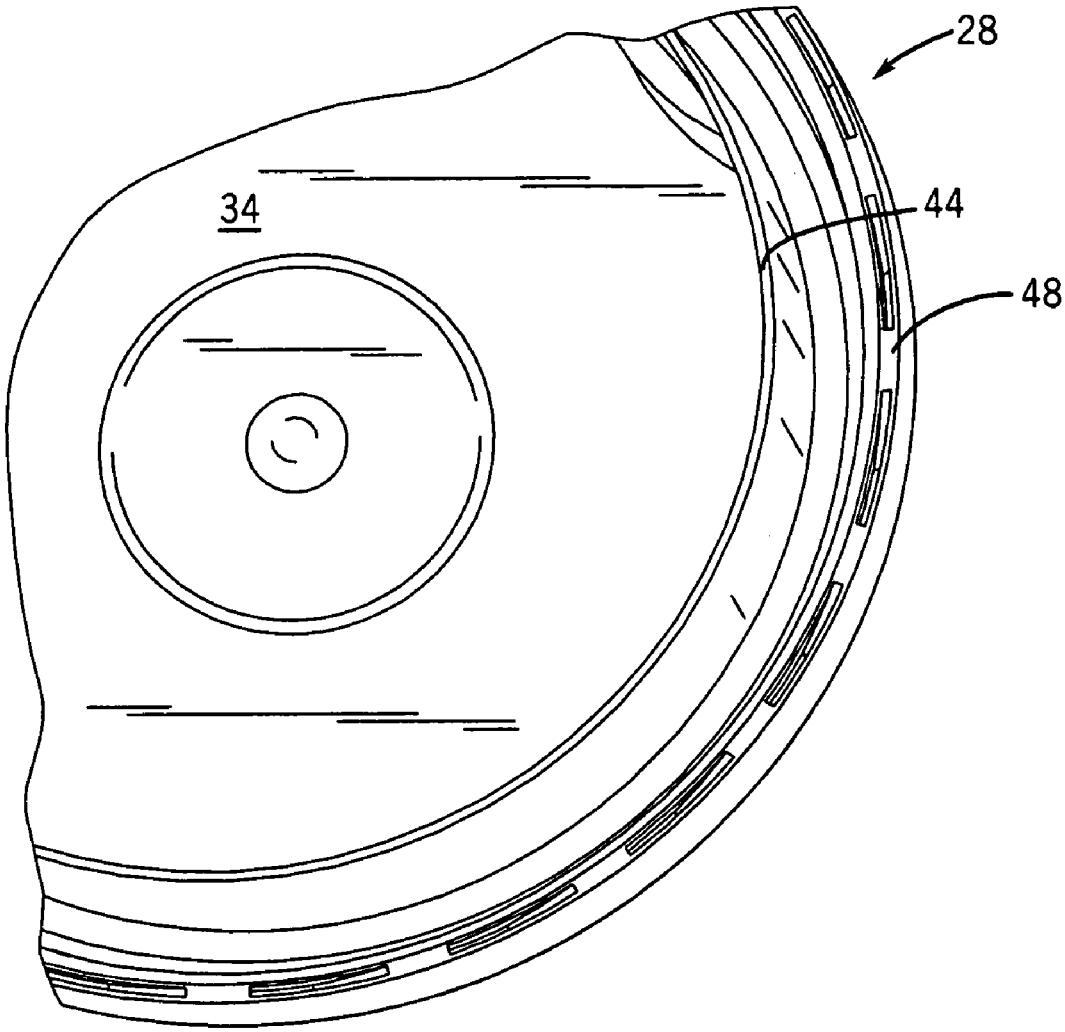
FIG. 6 is a bottom view of the lid of FIG. 4.

Referring to FIGS. 4 through 6, cap 28 includes an inner wall or partition 44 vertically projecting from planar surface 34 from the interior of cap 28. A gap 46 between partition 44 and an exterior rim 48 of cap 28 provides a cavity to receive the threads of neck 30 of body 12. Female thread in rim 48 is configured to cooperate with the male threads of neck 30 to secure cap 28 to body 14. When cap 28 is inverted and used as a paint dish or tray, partition 44 inhibits paint from access to the female threads of rim 48.

According to a preferred embodiment, the container is formed from a plastic material that may be injection molded, blow molded, or injection blow molded. The container may be formed from any other method known in the art.

Referring generally to FIGS. 1-3, the cap is easily removed both in the retail outlet for easy tinting and at home or on the job site without requiring additional tools. Once the tinting coloring has been added, the cap is screwed back on to the body of the container such that the top of the cap and the top surface of the handle are in the same plane. The paint in the container can then be mixed utilizing a standard mixing apparatus where the top and bottom of the container are trapped and compressed between two surfaces and subsequently shaken. The surface area of the handle and cap provide a stable surface for this type of compression apparatus. The container may employ other geometries to ensure that the container may be securely located in a compression type mixer. The mixer itself could employ a top member that matches the profile of the top of the container including the handle and cap. The container, cap and/or handle could include raised features to permit the top member of the mixer to effectively clamp onto the container for mixing.

Figure 7A:
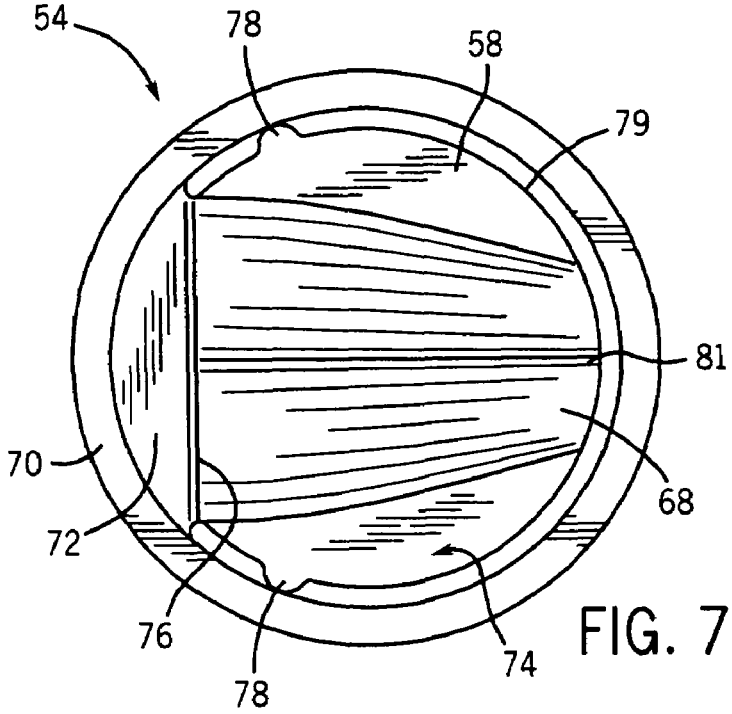
FIG. 7A is a top view of an alternative spout embodiment.
Figure 7B:
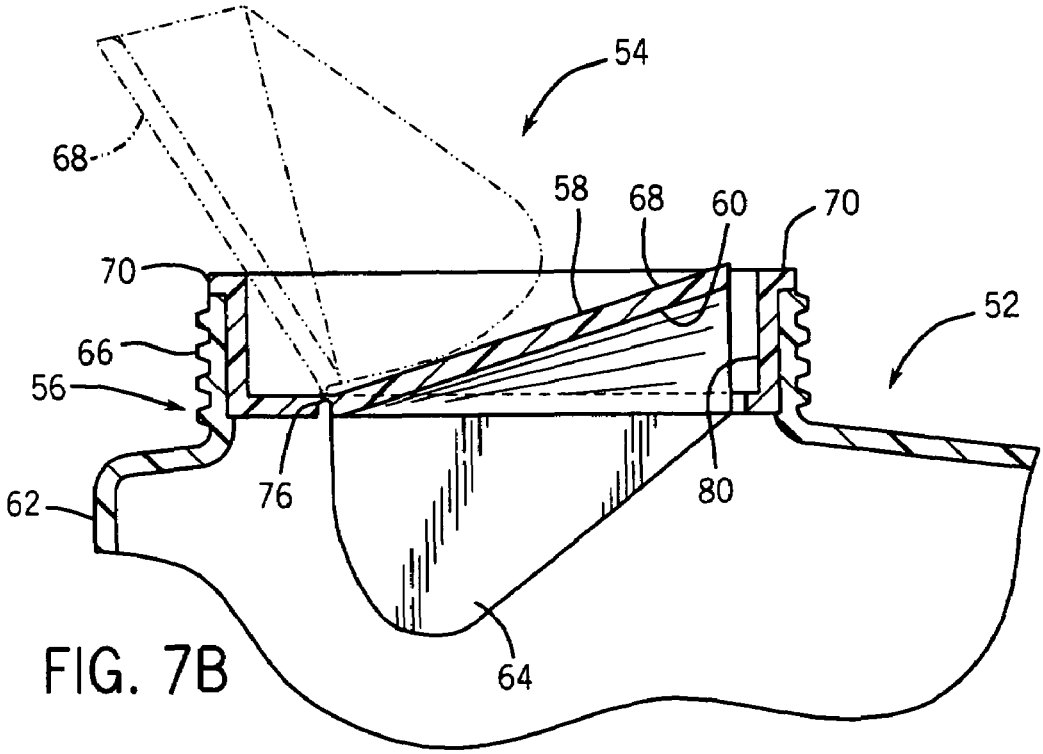
FIG. 7B is cross-sectional view of the spout of FIG. 7.

Referring to FIGS. 7A-7B a paint container 52 having a spout 54 selectively reconfigurable between a retracted storage or non-use position and an extended use position is shown according to an alternative embodiment. A spout 54 that is "flipped" or opened to the extended position is shown in FIG. 7E. The spout 54 may be molded to the neck 56 or be provided as a separate insert according to alternative embodiments. The spout 54 is in a "down" position when the container rests on a base of the body. As the container is "tipped" to pour the paint out of the spout, the spout "flips" to the "up" position (e.g. by gravity and or by the force of the paint). The paint flows down the spout and over the neck (and threads of the neck). To return the spout 54 to the down position, the container is replaced to its original (upright) position and the spout automatically returns to the down position. According to an alternative embodiment, the spout may be manually replaced to the down position (e.g. by placement of the cap on the neck of the container).

Spout 54 includes a first side 58 that faces upward when the spout 54 is in a retracted or closed position. A second side 60 is opposite first side 58 and acts as the surface that paint flows over when paint is being poured from the body 62 of container 52. Spout 54 includes a pair of side walls 64 that extends outward from second side 60 in a direction away from first side 58. Side walls 64 act to retain and direct the flow of paint as being paint is being poured over spout 54. The side walls 64 act to prevent or minimize paint from overflowing the sides of the spout as it is being poured from the container. The side walls 64 extend a sufficient height to prohibit paint from overflowing and soiling the threads 66 of the container as well as the container itself.

Spout 54 further includes a center region 68 having a concave shape as viewed from second side 60 and a convex shape as viewed from first side 58. The concave shape of the center region 68 of spout 54 further aids in directing the flow of paint. In one embodiment, spout 54 includes an outer rim that operatively engages the upper edge of neck 56 of container 52. A first sloping region 72 extends downward and away from rim 70. Side walls 64 and center region 68 form the region or flapper 74 that guides the paint as it is being poured from the container. Flapper 74 is pivotally attached to sloping region 72 with a living hinge 76. A tab 78 may be used to securely lock region 74 to insert rim 70. Sloping region 72 also provides the benefit of a drain back guide in which any paint that drips into sloping region 72 is guided back into the container. In one embodiment, rim 70 includes a detent that engages tab 78 in the open position. Additionally, rim 70 may include a detent on a lower portion 80 of rim 70 that would engage the tab 78 when the spout is in the recessed or closed position. In an exemplary embodiment two tabs 78 are employed, however one or more tabs may be used.

In the recessed or closed position first surface 58 of spout 54 is located below the upper edge of neck 56 of the container. This permits a standard paint cover to be used without the need to accommodate the spout portion that would otherwise extend above the top edge of the neck. The spout 54 may extend beyond the outer edge of the neck. This helps to minimize dripping of paint on to the threads of the neck. Further, the front edge of the spout may extend beyond the outer periphery of the container thereby minimizing dripping of paint on to the outside of the container.

Flapper 74 an outer periphery 79 that is proximate but spaced from rim 70 defining a gap. Spout 54 may include a thin molded membrane covering that would cover the gap between the outer periphery 79 and rim 70 that would break open by lifting the flapper 74 about the living hinge. As a result of gravity and the force of paint being poured out of the container, flapper 74 will automatically move from the retracted to the extended position as it is being poured. Additionally, given the bias of the living hinge 76 and the viscosity of paint flapper 74 will automatically be returned to a retracted position when the container is tilted upright. The convex shape of the center region 68 of flapper 74 guides any paint that may enter into that region into the container through the gap between the outer periphery 81 of the flapper and the rim 70.

Figure 8A:
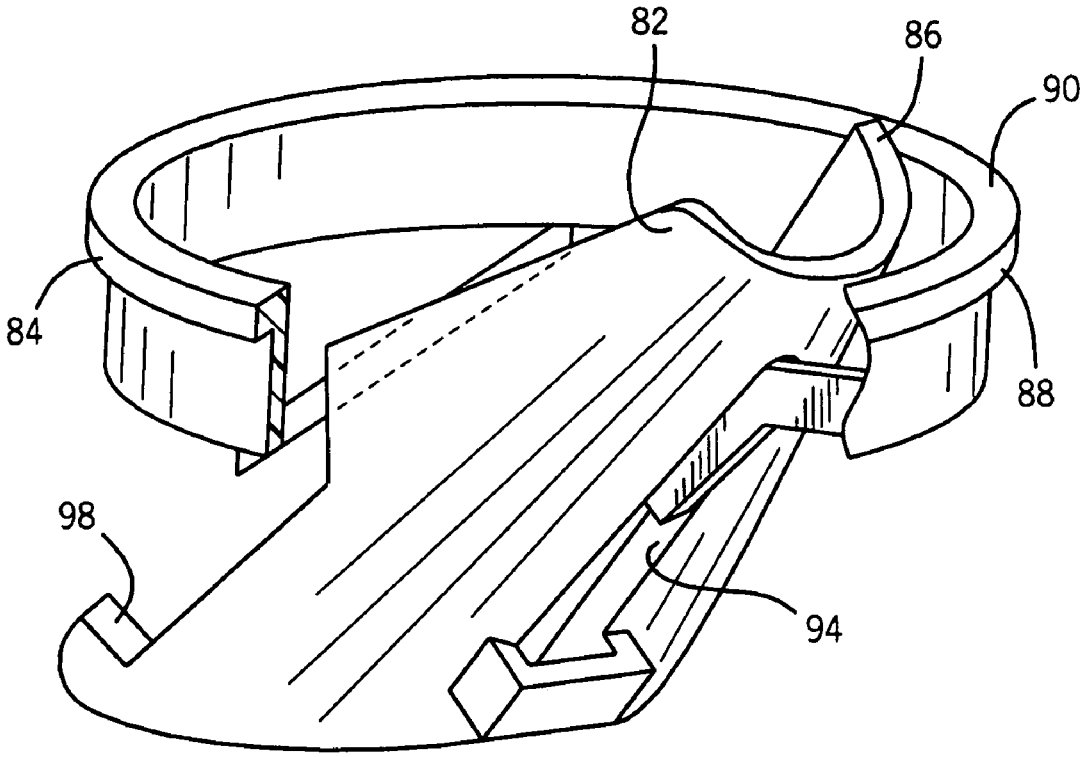
FIG. 8A is an isometric view of an alternative spout embodiment.
Figure 8B:
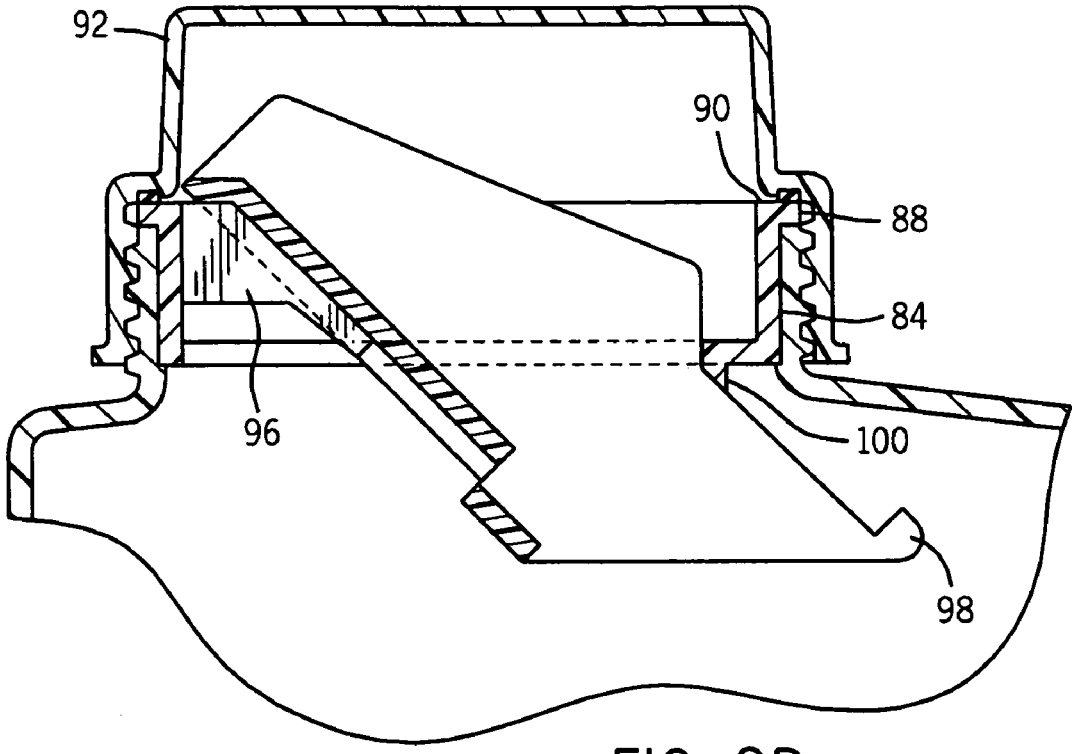
FIG. 8B is a cross-sectional view of the spout of FIG. 8 in a disengaged position.
Figure 8C:
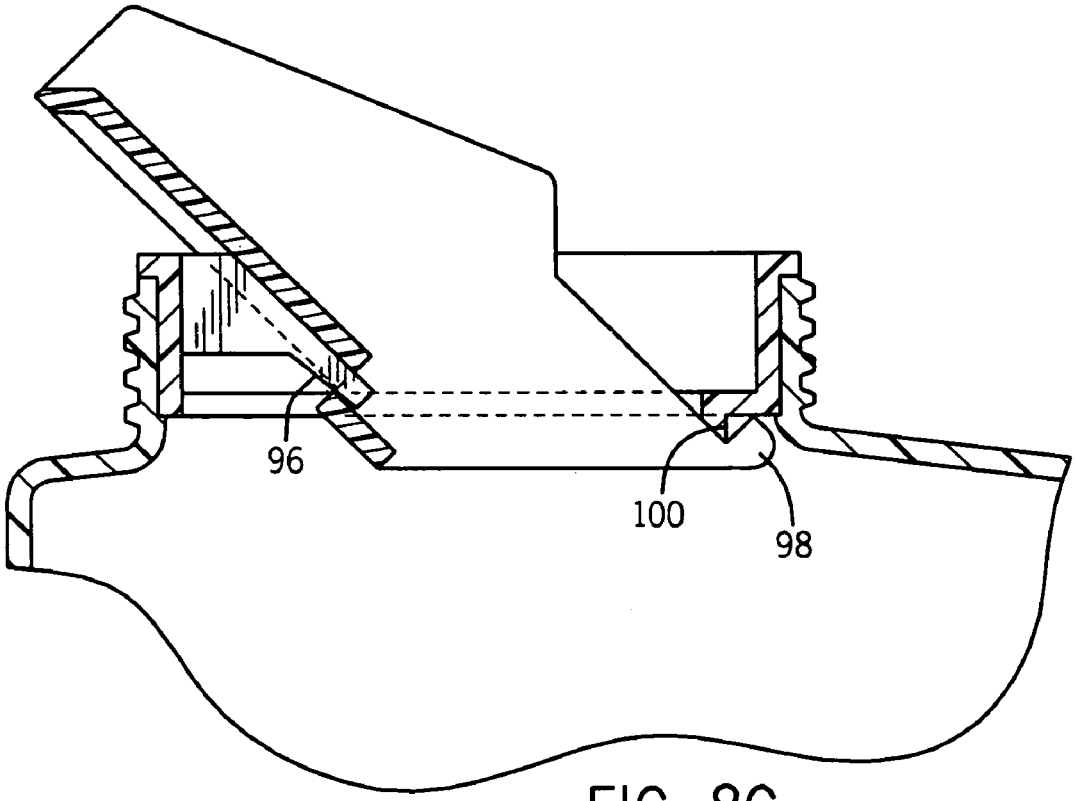
FIG. 8C is a cross sectional view of the spout of FIG. 8 in engaged position.

Referring to FIGS. 8A-8C a spout 82 slides at an angle relative to an insert 84 that is secured to the neck of a paint container body. Spout 82 slides from a retracted position in which an upper edge 86 of spout does not extend beyond the outer periphery 88 of insert 84. In one embodiment, upper edge 86 is also below the upper surface 90 of insert 84 when the spout 82 is in the retracted position. A cover or lid 92 may be secured to the container and or insert such that the spout 82 does not interfere with lid 92. Spout 82 includes a groove or channel 94 that receives a rib or guide 96 that is secured to insert 84. Spout 84 is movable from a retracted position to an extended position, by sliding spout 84 along rib or guide 96. Spout 84 includes a lower engagement extension 98 that abuts a lower edge 100 of insert 84 to prohibit spout 84 from sliding out of the container all together. Further contact of extension 98 with the lower edge 100 of insert 84 provides a counter effect to the moment that may result as paint is poured over the spout.

It is important to note that the construction and arrangement of the elements of the paint containers as shown in the preferred and other exemplary embodiments is illustrative only. Although only a few embodiments of the present inventions have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, orientations, etc.) without materially departing from the novel teachings and advantages of the subject matter recited in this disclosure. It should also be understood that the various elements described herein can be combined in combinations other than as illustrated, for example, the hinged spout can include the bead for indexing, more than one handle can be coupled to the body, and the covers can be configured as child-resistant. Accordingly, all such modifications are intended to be included within the scope of the present inventions as set forth in the appended present application. The order or sequence of any process or method steps may be varied or re-sequenced according to alternative embodiments. Other substitutions, modifications, changes and omissions may be made in the design, operating conditions and arrangement of the preferred and other exemplary embodiments without departing from the spirit of the present inventions as expressed in the present application. It is intended that the scope of the invention be defined by the claims appended hereto an their equivalents.

What is claimed is:

1. A paint container, comprising:

a body including a bottom, at least one side wall, a top having an opening extending therethrough to an interior of the body defined by the top, bottom and side wall; and a spout movable from a retracted position wherein at least a portion of the spout is within the interior of the body to an extended position wherein at least an upper edge of the spout is outside the interior of the body, wherein the top includes a neck extending from the top about a perimeter of the opening, the neck threadably receiving a lid, wherein at least the upper edge of the spout is outside the perimeter of the opening when the spout is in the extended position and inside the perimeter when the spout is in the retracted position, and wherein the side wall defines an outer periphery, the upper edge of the spout extending beyond the outer periphery in the extended position.

2. The paint container of claim 1, wherein the spout pivots about a hinge to move between the retracted and the extended position.

3. The paint container of claim 2 wherein the hinge is a living hinge.

4. The paint container of claim 3, wherein the hinge is a double living hinge.

5. The paint container of claim 3, wherein the spout includes a flapper portion having at least one side wall extending upwardly therefrom when the spout is in the extended position.

6. The paint container of claim 5, wherein the interior of the body includes paint and wherein the side wall extends upwardly a distant sufficient to guide the paint from within the interior over the upper edge of the spout as the paint is being poured from the interior of the body.

7. The paint container of claim 5, wherein the flapper includes an outer periphery located inwardly from the neck to define a drain back opening through which paint may enter the interior of the body.

8. The paint container of claim 1, wherein the spout slides at an angle less than 90 degrees to a plane generally defined by the base.

9. A paint container comprising a hollow body having a base and a top including a neck defining a first aperture extending into the body, the hollow body having a rest position in which the base is substantially horizontal and a pour position in which the base is tilted sufficient to pour a paint from within the hollow body outward through the aperture; and a spout movable from a retracted position wherein a first portion of the spout is within the interior of the body to an extended position wherein the first portion of the spout is outside the interior of the body, the spout automatically moving from the retracted position to the extended position as the hollow body is tilted from the rest position to the pour position, wherein the spout automatically moves from the extended position to the retracted position when the body is moved from the pour position to the rest position, and wherein the spout includes a first surface facing away from the base when the spout is in the retracted position, and a second surface opposite the first surface and facing the base when the spout is in the retracted position, the spout including a center portion having a generally concave shape when the spout is viewed facing the second surface, the spout including a side portions extending toward the neck from each side of the center portion when the spout is in the retracted position.

10. The paint container of claim 9 further including a removable membrane sealingly engaging the spout with the neck.

11. The paint container of claim 9 further including a removable membrane sealingly engaging the spout with the neck.

12. The paint container of claim 11 further including a living hinge securing the neck to the spout and configured to permit the spout to pivot from the retracted position to the extended position.

13. The paint container of claim 12 wherein the neck includes a tab member to secure the spout to the body when the spout the body is in the retracted position.

14. The paint container of claim 13 wherein the spout covers substantially the entire opening of the aperture when the spout is in the retracted position.

15. The paint container of claim 9 further comprising an insert located within the neck and pivotally attached to the spout.

16. The paint container of claim 15, wherein the insert includes a sloping region that extends downwardly toward the interior of the container, the spout being pivotally secured to an end portion of the sloping region, the sloping region providing a drain back for paint that drips into the region between the spout and the neck.

17. The paint container of claim 9, wherein the entire spout is located below an upper edge of the neck when the spout is in the retracted position.

18. The paint container of claim 9, wherein the neck has external threads, configured to receive a cover.

19. A method of pouring paint from a container comprising providing a container having at least one side wall defining an outer periphery, a bottom, and a top having an opening extending therethrough to an interior of the body holding a paint product, and a bottom, the container including a spout pivotally coupled to the container proximate the opening;

tilting the container from a rest position in which the container rests on its bottom and automatically pivoting the spout from a retracted position where the spout is located within the opening to a pour position in which a portion of the spout is located outside of the container and extends beyond the outer periphery of the sidewall; and pouring the paint over the spout.

20. The method of claim 19 further including automatically pivoting the spout from the extend position to the retracted position by returning the container to rest on its bottom.

21. The method of claim 20, wherein the spout covers substantially the entire area of the opening when the spout is in the retracted position.

* * * * *